US010626478B2

(12) United States Patent
Schulz et al.

(10) Patent No.: US 10,626,478 B2
(45) Date of Patent: Apr. 21, 2020

(54) ULTRA HIGH-STRENGTH AIR-HARDENING MULTIPHASE STEEL HAVING EXCELLENT PROCESSING PROPERTIES, AND METHOD FOR MANUFACTURING A STRIP OF SAID STEEL

(71) Applicant: SALZGITTER FLACHSTAHL GMBH, Salzgitter (DE)

(72) Inventors: Thomas Schulz, Salzgitter (DE); Joachim Schöttler, Braunschweig (DE); Sascha Kluge, Crimmitschau (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 255 days.

(21) Appl. No.: 15/528,021

(22) PCT Filed: Nov. 6, 2015

(86) PCT No.: PCT/DE2015/100474
§ 371 (c)(1),
(2) Date: May 18, 2017

(87) PCT Pub. No.: WO2016/078644
PCT Pub. Date: May 26, 2016

(65) Prior Publication Data

US 2019/0316222 A1 Oct. 17, 2019

(30) Foreign Application Priority Data

Nov. 18, 2014 (DE) ..... 10 2014 017 274

(51) Int. Cl.
*C21D 6/00* (2006.01)
*C21D 8/02* (2006.01)
(Continued)

(52) U.S. Cl.
CPC ..... *C21D 9/52* (2013.01); *C21D 6/002* (2013.01); *C21D 6/005* (2013.01); *C21D 6/008* (2013.01);
(Continued)

(58) Field of Classification Search
CPC ..... C21D 6/002; C21D 6/005; C21D 6/008; C21D 8/0205; C21D 8/0263;
(Continued)

(56) References Cited

U.S. PATENT DOCUMENTS 5,360,676 A * 11/1994 Kuguminato ..... C21D 8/0426 428/682
6,702,904 B2 * 3/2004 Kami ..... C21D 8/0226 148/320
(Continued)

FOREIGN PATENT DOCUMENTS

DE 196 10 675 C1 2/1997
DE 100 37 867 A1 6/2001
(Continued)

OTHER PUBLICATIONS

English International Search Report issued by the European Patent Office in International Application PCT/DE2015/100474 dated Nov. 6, 2015.

*Primary Examiner* — Cam N. Nguyen
(74) *Attorney, Agent, or Firm* — Henry M. Feiereisen LLC

(57) ABSTRACT

An ultra-high-strength air-hardenable multiphase steel having minimal tensile strengths in a non air hardened state of 950 MPa and excellent processing properties, includes the following elements in % by weight: C≥0.075 to ≤0.115; Si≥0.400 to ≤0.500; Mn≥1,900 to ≤2,350; Cr≥0.200 to ≤0.500; Al≥0.005 to ≤0.060; N≥0.0020 to ≤0.0120; S≤0.0030; Nb≥0.005 to ≤0.060; Ti≥0.005 to ≤0.060;
(Continued)

Process chain (schematically) for the production of a component from the steel according to the invention B≥0.0005 to ≤0.0030; Mo≥0.200 to ≤0.300; Ca≥0.0005 to ≤0.0060; Cu≤0.050; Ni≤0.050; remainder iron, including usual steel accompanying smelting related impurities, wherein for a widest possible process window during continuous annealing of hot rolled or cold rolled strips made from said steel a sum content of M+Si+Cr in said steel is a function of a thickness of the steel strips according to the following relationship: for strip thicknesses of up to 1.00 mm the sum content of M+Si+Cr is ≥2.800 and ≤3.000%, for strip thicknesses of over 1.00 to 2.00 mm the sum of Mn+Si+Cr is ≥2.850 and ≤3.100%, and for strip thicknesses of over 2.00 mm the sum of Mn+Si+Cr is ≥2.900 and ≤3.200%.

37 Claims, 7 Drawing Sheets

(51) Int. Cl.

| | |
|---|---|
| ***C21D 9/52*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C23C 2/02*** | (2006.01) |
| ***C23C 2/28*** | (2006.01) |
| ***C23C 2/40*** | (2006.01) |

(52) U.S. Cl.
CPC ..... *C21D 8/0205* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C23C 2/02* (2013.01); *C23C 2/28* (2013.01); *C23C 2/40* (2013.01); *C21D 2211/002* (2013.01); *C21D 2211/005* (2013.01); *C21D 2211/008* (2013.01); *C21D 2241/00* (2013.01)

(58) Field of Classification Search
CPC ..... C21D 8/0278; C21D 9/52; C22C 38/001; C22C 38/002; C22C 38/02; C22C 38/06; C22C 38/22; C22C 38/24; C22C 38/26; C22C 38/28; C22C 38/32; C22C 38/38; C23C 2/02; C23C 2/28; C23C 2/40
See application file for complete search history.

(56) References Cited

U.S. PATENT DOCUMENTS

| | | | | |
|---|---|---|---|---|
| 6,764,555 | B2 * | 7/2004 | Hiramatsu | C21D 6/004 148/325 |
| 6,899,771 | B2 * | 5/2005 | Kami | C21D 8/0226 148/320 |
| 6,902,632 | B2 * | 6/2005 | Kami | C21D 8/0226 148/320 |
| 6,962,631 | B2 * | 11/2005 | Sugiura | C21D 1/185 148/320 |
| 8,357,247 | B2 * | 1/2013 | Hirasawa | C22C 38/001 148/310 |
| 8,404,061 | B2 | 3/2013 | Braun et al. | |
| 8,608,873 | B2 * | 12/2013 | Abratis | C21D 8/0426 148/325 |
| 8,657,969 | B2 * | 2/2014 | Kawasaki | C21D 8/0205 148/320 |
| 8,657,971 | B2 * | 2/2014 | Hirasawa | C21D 1/18 148/326 |
| 8,882,938 | B2 * | 11/2014 | Ennis | B32B 15/013 148/333 |
| 9,493,865 | B2 * | 11/2016 | Kami | C21D 1/25 |
| 9,512,499 | B2 * | 12/2016 | Tomokiyo | C21D 9/46 |
| 9,534,268 | B2 * | 1/2017 | Ratte | C21D 1/06 |
| 9,534,271 | B2 * | 1/2017 | Kosaka | B32B 15/013 |
| 9,540,720 | B2 * | 1/2017 | Azuma | C23C 2/06 |
| 9,598,745 | B2 * | 3/2017 | Hayashi | C21D 8/0226 |
| 9,677,150 | B2 * | 6/2017 | Ennis | B32B 15/013 |
| 9,809,869 | B2 * | 11/2017 | Nakagawa | C21D 8/0205 |
| 9,840,751 | B2 * | 12/2017 | Hayashi | C21D 8/0226 |
| 9,896,736 | B2 * | 2/2018 | Tomokiyo | C21D 9/0068 |
| 10,030,280 | B2 * | 7/2018 | Hayashi | C21D 9/46 |
| 10,053,757 | B2 * | 8/2018 | Hanlon | C21D 8/0426 |
| 10,202,664 | B2 * | 2/2019 | Krizan | C21D 8/0226 |
| 10,351,942 | B2 * | 7/2019 | Yokoyama | C21D 8/02 |
| 2007/0144632 | A1 * | 6/2007 | Toyoda | C21D 8/0226 148/593 |
| 2009/0173412 | A1 | 7/2009 | Schöttler et al. | |
| 2010/0273024 | A1 | 10/2010 | Bocharova et al. | |
| 2011/0024006 | A1 | 2/2011 | Schöttler et al. | |
| 2011/0120598 | A1 * | 5/2011 | Nonaka | C22C 38/02 148/541 |
| 2011/0220252 | A1 | 9/2011 | Hammer et al. | |
| 2012/0018056 | A1 * | 1/2012 | Nakagawa | C21D 8/0205 148/506 |
| 2012/0107632 | A1 | 5/2012 | Braun et al. | |
| 2013/0209831 | A1 * | 8/2013 | Becker | C21D 7/02 428/653 |
| 2014/0007992 | A1 * | 1/2014 | Balichev | B22D 11/0622 148/546 |
| 2014/0034196 | A1 | 2/2014 | Wedemeier et al. | |
| 2014/0205858 | A1 * | 7/2014 | Ennis | C21D 9/46 428/659 |
| 2015/0020992 | A1 | 1/2015 | Schöttler et al. | |
| 2015/0034215 | A1 | 2/2015 | Schulz et al. | |
| 2015/0041024 | A1 | 2/2015 | Schulz et al. | |
| 2015/0059935 | A1 * | 3/2015 | Hebesberger | C22C 38/001 148/623 |
| 2015/0152533 | A1 * | 6/2015 | Bongards | C21D 6/02 148/518 |
| 2015/0292054 | A1 * | 10/2015 | Kami | C21D 8/0226 52/831 |
| 2015/0337408 | A1 | 11/2015 | Schulz et al. | |
| 2016/0017467 | A1 * | 1/2016 | Balichev | C21D 8/0405 148/546 |
| 2016/0017472 | A1 * | 1/2016 | Ennis | B32B 15/013 428/659 |
| 2016/0190598 | A1 * | 6/2016 | Majima | B23K 20/04 429/231.8 |
| 2017/0275720 | A1 * | 9/2017 | Kami | C21D 6/005 |
| 2019/0226068 | A1 * | 7/2019 | Bonnefois | C22C 38/005 |

FOREIGN PATENT DOCUMENTS

| | | | |
|---|---|---|---|
| EP | 1 807 544 | B1 | 2/2008 |
| EP | 1 990 431 | A1 | 11/2008 |
| EP | 2 028 282 | A1 | 2/2009 |
| EP | 2 031 081 | A1 | 3/2009 |
| EP | 2 426 230 | A1 | 3/2012 |
| EP | 2 578 718 | A1 | 4/2013 |
| WO | WO 2008/054166 | A1 | 5/2008 |
| WO | WO 2011/000351 | A1 | 1/2011 |
| WO | WO 2012/100762 | A1 | 8/2012 |
| WO | WO 2013/113304 | A1 | 8/2013 |

* cited by examiner

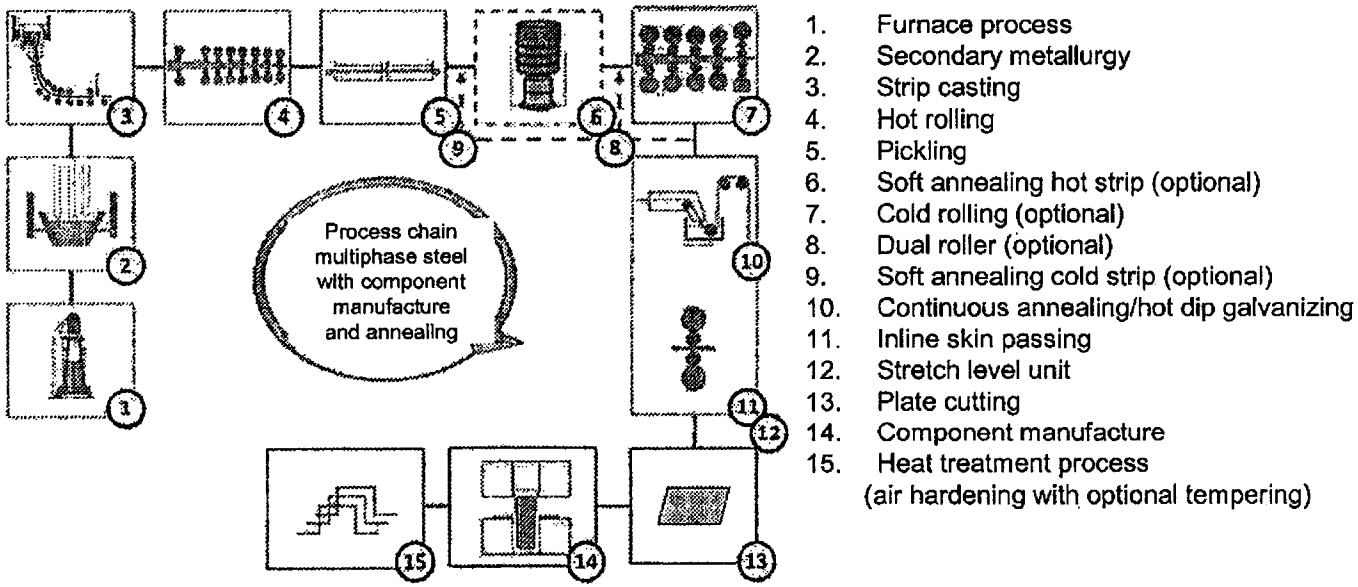
Figure 1: Process chain (schematically) for the production of a component from the steel according to the invention

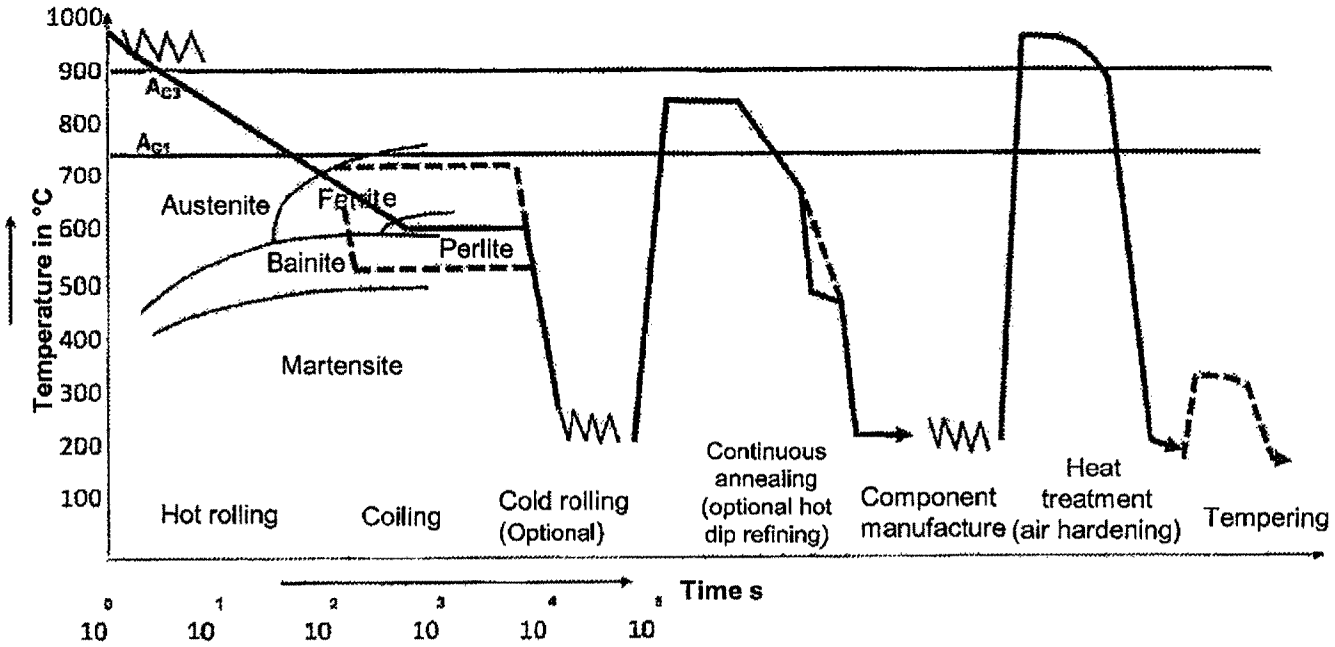
Figure 2: Time Temperature-course (schematically) of the process chain hot rolling and Cold rolling (optional) and co0ntinuous annealing as well as co0mponent manufacture, temperature treatment (air hardening) and tempering (optional) exemplary for the steel according to the invention

| Steel alloy | C % | Si % | Mn % | P % | S % | N % | Al % | Cr % | Mo % | Ti % | V % | Nb % | B % | Ca % |
|---|---|---|---|---|---|---|---|---|---|---|---|---|---|---|
| LH®600 reference | 0,091 | 0,294 | 1,929 | 0,011 | 0,001 | 0,0069 | 0,036 | 0,783 | 0,224 | 0,0267 | 0,072 | 0,0019 | 0,0031 | 0,0010 |
| LH®900 reference | 0,092 | 0,260 | 1,883 | 0,012 | 0,003 | 0,0080 | 0,027 | 0,758 | 0,489 | 0,0250 | 0,135 | 0,0020 | 0,0033 | 0,0008 |
| LH®1100 reference | 0,100 | 0,456 | 2,139 | 0,010 | 0,001 | 0,0050 | 0,058 | 0,313 | 0,202 | 0,0289 | - | 0,0337 | 0,0009 | 0,0021 |
| LH®1100 invention | 0,099 | 0,461 | 2,179 | 0,009 | 0,001 | 0,0048 | 0,040 | 0,312 | 0,208 | 0,0292 | - | 0,0384 | 0,0012 | 0,0015 |

Figure 3a

| | CEV (IIW) % | Cr+Mo % | Nb+Ti % | Nb+Ti+B % | Nb+Ti+B+Mo % | Mn+Si+Cr % |
|---|---|---|---|---|---|---|
| LH8600 reference | 0,6316 | 1,007 | 0,0286 | 0,0317 | 0,2557 | 3,006 |
| LH8900 reference | 0,6935 | 1,249 | 0,0270 | 0,0303 | 0,5299 | 2,899 |
| LH01100 invention | 0,5620 | 0,515 | 0,0828 | 0,0835 | 0,2718 | 2,908 |
| LH01100 invention | 0,5730 | 0,520 | 0,0838 | 0,0888 | 0,2847 | 2,952 |

Figure 3b: Chemical composition of the investigated steels

| Target values air hardened - non tempered - | Re MPa | Rm MPa | A5 % |
|---|---|---|---|
| LH8600 reference | 600 – 700 | 800 - 900 | ≥ 15 |
| LH8900 reference | 700 – 800 | 900 - 1000 | ≥ 13 |
| LH01100 invention | 900 – 1000 | 1100 - 1200 | ≥ 9 |

Figure 4a: Mechanical characteristic values (longitudinally to the rolling direction) as target values, air-hardened and non-tempered

| Starting state longitudinally | Thickness mm | Re MPa | Rm MPa | A5 % | A80 % | Re/Rm % |
|---|---|---|---|---|---|---|
| LH8600 reference | 2,0 | 303 | 479 | ./. | 26,5 | 63 |
| LH8900 reference | 2,0 | 351 | 549 | ./. | 26,5 | 64 |
| LH01100 invention | 1,2 | 768 | 984 | ./. | 16,7 | 78 |
| LH01100 invention | 2,0 | 708 | 983 | ./. | 11,7 | 72 |

Figure 4b: Mechanical characteristic values (longitudinally to the rolling direction) of the investigated steels in the starting state

| Air hardened -non tempered - longitudinally | Thick-ness mm | Re *1) MPa | Rm *1) MPa | A5 % | A80 % |
|---|---|---|---|---|---|
| LH®800 reference | 2,0 | 695 | 882 | 15,6 | 6,5 |
| LH®900 reference | 2,0 | 755 | 994 | 13,7 | 4,7 |
| LH®1100 invention | 1,2 | 921 | 1198 | 9,5 | 5,5 |
| LH®1100 invention | 2,0 | 903 | 1186 | 9,1 | 7,1 |

*1) In the optional tempering it can be assumed that the yield strength increases and the tensile strength decreases

Figure 4c: Mechanical characteristic values of the investigated steels (longitudinally to the rolling direction) in the air-hardened and non-tempered

| Starting state | Thick-ness mm | LAW % | α, longi-tudinal ° | α, trans-verse ° | Rm x α, longitudinal MPa ° | Rm x α, transverse MPa ° |
|---|---|---|---|---|---|---|
| LH®1100 invention | 1,2 | 49 | 122 | 112 | 146156 | 134176 |
| LH®1100 invention | 2,0 | 32 | 104 | 88 | 123344 | 104368 |

Figure 5: Results of the hole expansion tests according to ISO 16630 of the platelet bending test according to VDA 238-100 longitudinally and transversely to the rolling direction) on the steel according to the invention according to Figure 3

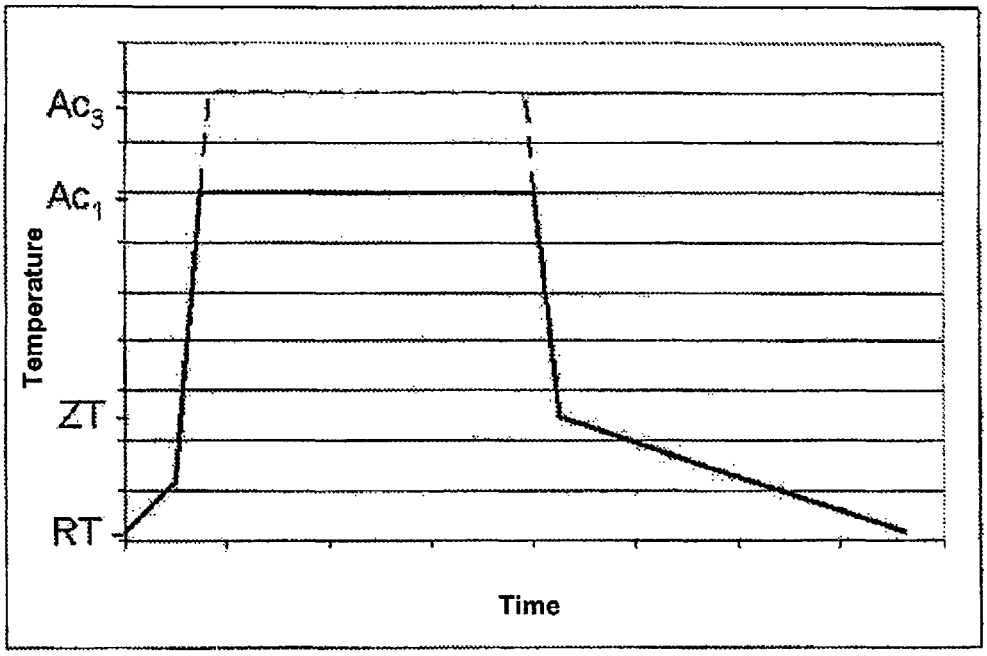
Figure 6a: Method 1, temperature-time-curves (annealing variants schematically)
Legend: ZT = Intermediate temperature, RT = room temperature
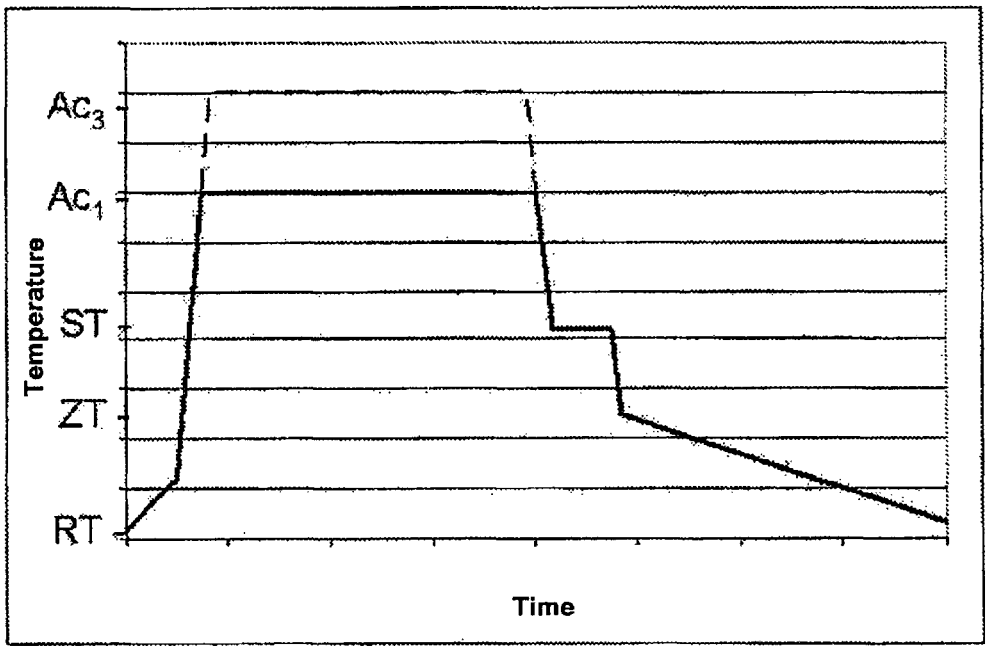
Figure 6b: Method 2, temperature-time-curves (annealing variants schematically)
Legend: ST = hot dip bath temperature, ZT = intermediate temperature, RT = room temperature

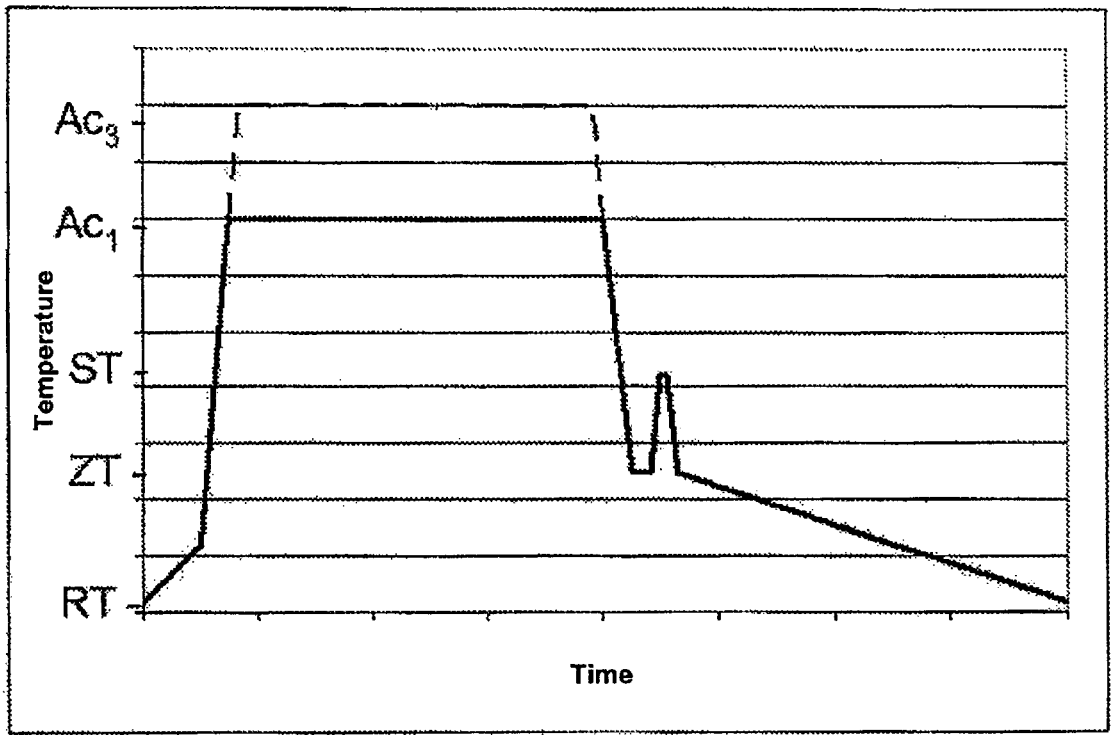
Figure 6c: Method 3, temperature-time-curves (annealing variants schematically)
Legend: ST = hot dip bath temperature, ZT = intermediate temperature, RT = room temperature

ULTRA HIGH-STRENGTH AIR-HARDENING MULTIPHASE STEEL HAVING EXCELLENT PROCESSING PROPERTIES, AND METHOD FOR MANUFACTURING A STRIP OF SAID STEEL

CROSS-REFERENCES TO RELATED APPLICATIONS

This application is the U.S. National Stage of International Application No. PCT/DE2015/100474, filed Nov. 6, 2015, which designated the United States and has been published as International Publication No. WO 2016/078644 A1 and which claims the priority of German Patent Application, Serial No. 10 2014 017 274.0, filed Nov. 18, 2014, pursuant to 35 U.S.C. 119(a)-(d).

BACKGROUND OF THE INVENTION

The invention relates to a high-strength, air-hardenable, multi-phase steel with excellent processing properties. Advantageous refinements are the subject of dependent claims.

The invention also relates to a method for producing a hot-rolled and/or cold-rolled strip from such a steel and its heat treatment by means of air-hardening and, optionally, subsequent tempering, and a steel strip produced by this method.

The invention relates in particular to steels having a tensile strength in the range of at least 950 MPa in the non-annealed state for the production of components which have improved deformability (such as increased hole expansion and increased bending angles) and improved weld properties.

By heat treating these steels according to the invention, the yield strength and tensile strength can be increased, for example, by air-hardening with optional subsequent tempering.

The hotly contested automotive market forces manufacturers to constantly find solutions to reduce fleet consumption and $CO_2$ emissions, while maintaining the greatest possible comfort and occupant protection. On the one hand, the weight reduction of all vehicle components plays a decisive role but on the other hand also the optimal behavior of the individual components under conditions of high static and dynamic stress both during use and in the event of a crash.

By providing high-strength to ultra-high-strength steels and reducing the thickness of the sheet metal, the weight of the vehicles can be reduced while simultaneously improving the forming characteristics and component properties during manufacture and operation.

Therefore, high-strength to ultra-high-strength steels must meet comparatively high requirements with respect to their strength and ductility, energy absorption and processing, such as, for example, during punching, hot and cold forming, hot tempering (e.g. air-hardening, press-hardening), welding and/or surface treatment, e.g. a metallic refinement, organic coating or varnishing.

Therefore, in addition to the demanded reduction in weight through reduced sheet thicknesses, newly developed steels must meet the increasing requirements placed on materials such as yield strength, tensile strength, solidification behavior and elongation at break while also possessing good processing properties such as deformability and weldability.

Therefore, when reducing the sheet thickness as mentioned above, a high-strength to ultra-high-strength steel with a single-phase or multi-phase microstructure has to be used to ensure sufficient strength of the motor vehicle components and to meet the high requirements placed on component in terms of tenacity, edge crack resistance, improved bending angle and bending radius, energy absorption and hardening capacity, and Bake Hardening Effect.

There is also an increasing demand for improved suitability for joining in the form of better general weldability, such as a larger usable welding area when using resistance spot welding and an improved failure behavior of the weld seam (fracture pattern) under conditions of mechanical stress, as well as a sufficient resistance to delayed hydrogen embrittlement (i.e., delayed fracture free). The same applies to the suitability for welding of ultra-high-strength steels in the production of pipes, which are produced, for example, by means of the High-Frequency Induction welding method (HFI).

The hole expansion capacity is a material property which describes the resistance of the material against the risk of fracture and crack propagation during forming operations in areas close to the edge, such as for example, during collar forming.

The hole expansion test is, for example, governed by the normative standard ISO 16630. Prefabricated holes, for example, punched into a sheet, are then expanded by means of a mandrel. The measured value is the change in the hole diameter relative to the starting diameter, at which the first crack occurs through the sheet at the edge of the hole.

Improved edge crack resistance means increased deformability of the sheet edges and can be described by an increased hole expansion capacity. This is known under the synonyms "Low Edge Crack" (LEC) and "High Hole Expansion" (HHE) as well as Xpand®.

The bending angle describes a material property which allows drawing conclusions regarding the material behavior during forming operations with dominant bending processes (for example, during folding) or also when subjected to crash loads. Increased bending angles therefore increase the passenger compartment safety. The determination of the bending angle ($\alpha$) is governed by the plate bending test set forth in the normative standard VDA 238-100.

The above mentioned characteristics are important for components which, prior to heat treatment, for example air hardening with optional tempering, can be formed into very complex components.

Improved weldability, as is known, is achieved inter alia by a reduced carbon equivalent. Synonyms therefore are for example "underperitical" (UP) or the already known "Low Carbon Equivalent" (LCE). Hereby the carbon content is typically less than 0.120% by weight. Furthermore, the failure behavior or the fracture pattern of the weld seam can be improved by alloying with micro-alloying elements.

Components of high strength must have sufficient resistance against hydrogen induced material embrittlement. Testing of Advanced High Strength Steels (AHSS) used in automotive production for resistance against production-related hydrogen-induced brittle fractures is governed by SEP1970 and is tested via the bent beam test and the perforation tensile test. In vehicle construction, dual-phase steels are increasingly used which consist of a ferritic basic microstructure into which a martensitic second phase is incorporated. It has been found that in the case of low-carbon, micro-alloyed steels, proportions of further phases such as bainite and residual austenite have an advantageous effect for example on the hole expansion behavior, the bending behavior and the hydrogen-induced brittle fracture behavior. The bainite can hereby be present in various forms, e.g. upper and lower bainite.

The specific material characteristics of the dual-phase steels, such as low yield ultimate ratio in association with very high tensile strength, strong strain hardening and good cold formability, are well known, but are often no longer sufficient with ever more complex component geometries.

In general, the group of multi-phase steels is increasingly used. The multi-phase steels include, for example, complex-phase steels, ferritic-bainitic steels, TRIP-steels, as well as the dual-phase steels described above, which are characterized by different microstructural compositions.

Complex phase steels are, according to EN 10346, steels which contain small proportions of martensite, residual austenite and/or perlite in a ferritic/bainitic basic microstructure, wherein a strong grain refinement is caused by a delayed recrystallization or precipitation of microalloying elements.

Compared to dual phase steels these complex phase steels have higher yield strengths, a higher yield ultimate ratio, a lower strain hardening and a higher hole expansion capacity.

Ferritic-bainitic steels are, according to EN 10346, steels containing bainite or work hardened bainite in a matrix of ferrite and/or work-hardened ferrite. The strength of the matrix is caused by a high dislocation density, by grain refining and the precipitation of micro-alloying elements.

Dual-phase steels are, according to EN 10346, steels with a ferritic basic microstructure, in which a martensitic second phase is incorporated in the form of islands, in some cases also with portions of bainite as the second phase. Dual-phase steels have a high tensile strength, while also exhibiting a low yield ultimate ratio and strong strain hardening.

TRIP-steels are, according to EN 10346, steels with a predominantly ferritic basic microstructure in which bainite and residual austenite are incorporated, which can transform into martensite during deformation (TRIP effect). Because of its strong strain hardening, the steel achieves high values of uniform elongation and tensile strength. Combined with the bake hardening effect, high component strengths can be achieved. These steels are suitable for stretch forming as well as for deep drawing. However, higher sheet metal holding forces and pressing forces are required during forming of the material. Comparatively strong rebounding must be taken into account.

High-strength steels with single-phase microstructure include for example bainitic and martensitic steels.

Bainitic steels are, according to EN 10346, characterized by a very high yield strength and tensile strength with a sufficiently high elongation for cold forming processes. Their chemical composition results in good weldability. The microstructure is typically composed of bainite. Small proportions of other phases, e.g. martensite and ferrite may be contained in the microstructure.

Martensitic steels are, according to EN 10346, steels which contain small proportions of ferrite and/or bainite in a basic microstructure of martensite as a result of thermo-mechanical rolling. This steel grade is characterized by a very high yield strength and tensile strength with a sufficiently high elongation for cold forming processes. Within the group of multi-phase steels, the martensitic steels have the highest tensile strength values. The suitability for deep drawing is limited. The martensitic steels are mainly suitable for bending forming processes, such as roll forming.

Heat treatable steels are, according to EN 10083, steels which achieve a high tensile strength and durability by heat treatment (=quench-hardening and tempering). When the cooling during hardening at air results in bainite or martensite, the method is referred to as "air-hardening". Via tempering after the hardening the strength/toughness ratio can be influenced in a targeted manner.

Areas of Application and Production Processes

High-strength and ultra-high-strength multi-phase steels are used, inter alia, in structural, chassis and crash-relevant components, as sheet metal plates, tailored blanks as well as flexible cold rolled strips, so-called TRB®s or tailored strips.

The Tailor Rolled Blank lightweight technology (TRB®) enables a significant weight reduction by means of a load-adapted sheet thickness over the component length and/or steel grade.

In the continuous annealing plant, a special heat treatment takes place for adjusting a defined microstructure, wherein for example comparatively soft constituents, such as ferrite or bainitic ferrite, result in a low yield strength of the steel, and hard constituents of the steel, such as martensite or carbon-rich bainite contribute to the strength of the steel.

For economic reasons, cold-rolled high-strength to ultra-high-strength steel strips are usually annealed in the continuous annealing process to a readily formable metal sheet. Depending on the alloy composition and the strip cross-section, the process parameters such as throughput speed, annealing temperatures and cooling rate (cooling gradients) are adjusted according to the required mechanical-technological properties with the microstructure required therefore.

For adjusting a dual-phase microstructure, the pickled hot strip, in typical thicknesses between 1.50 to 4.00 mm, or cold strip, in typical thicknesses of 0.50 to 3.00 mm, is heated in the continuous annealing furnace to such a temperature that the required microstructure forms during recrystallization and cooling.

Particularly in the case of different thicknesses in the transition region from one strip to the other it is difficult to achieve a constant temperature. In the continuous annealing of alloy compositions with process windows that are too narrow, this can lead to the fact that, for example, the thinner strip is either moved too slowly through the furnace, thereby lowering the productivity or the thicker strip is moved too quickly through the furnace thereby failing to achieve the required annealing temperatures and cooling gradients for achieving the desired microstructure. The consequences are increased rejects and high error costs.

Widened process windows are necessary so that, given the same process parameters, the required strip properties can be achieved even in the case of larger cross-sections of the strips to be annealed.

The problem of a very narrow process window is particularly pronounced in the annealing when load-optimized components are to be produced from hot-rolled or cold-rolled strip which have varying strip thicknesses over the strip length and width (for example, by flexible rolling).

However, when strongly varying sheet thicknesses are involved, production of TRB®s with multi-phase microstructure employing the presently known alloys and available continuous annealing systems requires increased costs, for example an additional heat treatment prior to the cold rolling. In regions of different sheet thickness, i.e., in case of varying degrees of rolling reduction, a homogenous multi-phase microstructure cannot be established in cold-rolled and hot-rolled steel strips due to the temperature difference in the conventional alloy-specific narrow process windows.

A method for producing a steel strip of different thickness over the strip length is e.g. described in DE 100 37 867 A1.

When high demands on corrosion protection require the surface of the hot or cold strip to be hot dip galvanized, the annealing is usually carried out in a continuous annealing furnace arranged upstream of the hot dip galvanizing bath.

Also in the case of hot strip, depending on the alloy concept, the demanded microstructure is not established until annealing in the continuous furnace, in order to realize the demanded mechanical properties.

Deciding process parameters are thus the adjustment of the annealing temperatures and the speed, but also the cooling rate (cooling gradient) in the continuous annealing because the phase transformation is temperature and time dependent. Thus, the less sensitive the steel is regarding the uniformity of the mechanical properties when the temperature and time course changes during the continuous annealing, the greater is the process window.

In continuous annealing of hot-rolled or cold-rolled steel strips of different thickness with the alloying concepts for a dual-phase steel known, for example, from laid open patent documents EP 2 028 282 A1, WO 2013/113304 A2 or EP 2 031 081 A1, the problem is that with these alloy compositions, Mechanical properties, but only a narrow process window for the annealing parameters is present in order to be used for cross-sectional jumps, e.g. in the case of width or thickness changes, it is possible to adjust uniform mechanical properties over the strip length without adapting the process parameters.

When using the known alloy concepts, the narrow process window makes it already difficult during the continuous annealing of strips with different thicknesses to establish uniform mechanical properties over the entire length and width of the strip.

In the case of flexibly rolled cold strip made of multiphase steels of known compositions, the too narrow process window either causes the regions with lower sheet thickness to have excessive strengths resulting from excessive martensite proportions due to the transformation processes during the cooling, or the regions with greater sheet thickness achieve insufficient strengths as a result of insufficient martensite proportions. Homogenous mechanical-technological properties across the strip length or width can practically not be achieved with the known alloy concepts in the continuous annealing.

The goal to achieve the resulting mechanical-technological properties in a narrow region across the strip width and strip length through controlled adjustment of the volume proportions of the microstructure phases has highest priority and is therefore only possible through a widened process window. The known alloy concepts for multiphase steels are characterized by a too narrow process window and are therefore not suited for solving the present problem, in particular in the case of flexibly rolled strips. With the alloy concepts known to date only steels of one strength class with defined cross sectional regions (sheet thickness and strip width) can be produced, hence requiring different alloy concepts for different strength classes or cross sectional ranges.

Steel production has seen a trend towards reducing the carbon equivalent to achieve improved cold processing (cold rolling, cold forming) and improved performance.

However, also the suitability for welding, characterized among other things by the carbon equivalent, is an important evaluation factor.

For example, in the following carbon equivalents $$CEV(IIW)=C+Mn/6+(Cu+Ni)/15+(Cr+Mo+V)/5$$

$$CET=C+(Mn+Mo)/10+(Cr+Cu)/20+Ni/40$$

$$PCM=C+(Mn+Cu+Cr)/20+Ni/60+Mo/15+V/10+5B$$

the characteristic standard elements, such as carbon and manganese, as well as chromium or molybdenum and vanadium (contents in % by weight) are taken into account.

Silicon plays only a subordinate role in the calculation of the carbon equivalent. This is of crucial importance with respect to the invention. The lowering of the carbon equivalent through lower contents of carbon as well as of manganese is to be compensated by increasing the silicon content. Thus the edge crack resistance and welding suitability are improved while maintaining same strengths.

A low yield ultimate ratio (Re/Rm) in a strength range above 950 MPa in the initial state is typical for a dual-phase steel and serves in particular the formability in drawing and deep drawing operations. This provides the constructor with information regarding the distance between ensuing plastic deformation and failing of the material at quasi-static load. Correspondingly lower yield strength ratios represent a greater safety margin for component failure.

A higher yield ultimate ratio (Re/Rm), as is typical for complex-phase steels, is also characterized by a high resistance against edge cracks. This can be attributed to the smaller differences in the strengths and hardnesses of the individual microstructural constituents and the finer microstructure, which has a favorable effect on a homogeneous deformation in the region of the cutting edge.

With respect to the yield strength as well as the yield ultimate ratio (Re/Rm) there is an overlapping range in the standards, in which an assignment to both complex and dual-phase steels is possible and leads to improved material properties.

The analytical landscape for the achievement of multiphase steels with minimum tensile strengths of 950 MPa is very diverse and shows very large alloying ranges for the strength-enhancing elements carbon, silicon, manganese, phosphorus, nitrogen, aluminum as well as chromium and/or molybdenum as well as the addition of microalloys such as titanium, niobium, vanadium and boron.

The dimensional spectrum in this strength range is wide and is in the thickness range of about 0.50 to about 4.00 mm for strips which are intended for continuous annealing. The used starting material can be a hot-rolled strip, cold-rolled hot-rolled strip and cold strip. Mainly strips up to a width of about 1600 mm are used, but also slit strips dimensions which result form longitudinal division of the strips. Sheet metals or plates are produced by cutting the strips transversely.

The air-hardenable steel grades known, for example, from EP 1 807 544 B1, WO 2011/000351 and EP 2 227 574 B1, with minimum tensile strengths of 800 (LH®800) and 900 MPa (LH®900), respectively, in a hot-rolled or cold-rolled version are characterized by their very good formability in the soft state (deep drawing properties) and by their high strength after heat treatment (tempering).

During hardening, the microstructure of the steel is transformed into the austenitic range by heating, preferably to temperatures above 950° C. under a protective gas atmosphere. During the subsequent cooling at air or protective gas, a martensitic microstructure is formed for a high-strength component.

Subsequent tempering allows the removal of residual stresses in the hardened component. At the same time, the hardness of the component is reduced so that the required toughness values are achieved.

SUMMARY OF THE INVENTION

It is therefore an object of the invention to provide a new cost-effective alloying concept for a highly durable, multiphase, air-conditioned steel having excellent processing properties and a minimum tensile strength of 950 MPa in the non-heat treated state, longitudinally and transversely to the rolling direction, preferably with a dual-phase microstructure with which the process window for the continuous annealing of hot or cold strips is widened in such a way that, in addition to strips with different cross sections, steel strips whose thickness varies over the strip length and optionally over the strip width can be produced with most homogeneous mechanical-technological properties.

In addition, the hot dip treatment of the steel is to be ensured and a process for the production of a strip made from this steel should be disclosed.

It is also intended to ensure sufficient formabiltiy, HFI weldability, excellent general weldability, and resistance to hot dip treatment and tempering.

According to the teaching of the invention, this object is achieved by a steel having the following chemical composition in % by weight:

C≥0.075 to ≤0.115
Si≥0.400 to ≤0.500
Mn≥1,900 to ≤2,350
Cr≥0.200 to ≤0.500
Al≥0.005 to ≤0.060
N≥0.0020 to ≤0.0120
S≤0.0030
Nb≥0.005 to ≤0.060
Ti≥0.005 to ≤0.060
B≥0.0005 to ≤0.0030
Mo≥0.200 to ≤0.300
Ca≥0.0005 to ≤0.0060
Cu≤0.050
Ni≤0.050 remainder iron and common steel accompanying, smelting related impurities, in which with regard to a widest possible process window during the continuous annealing of hot strip and cold strip made of this steel the sum content of Mn+Si+Cr is adjusted as a function of the thickness of the strip produced as follows:

Up to 1.00 mm: sum of Mn+Si+Cr≥2,800 and ≤3.000%
Over 1.00 to 2.00 mm: sum of Mn+Si+Cr≥2.850 and ≤3.100%
Over 2.00 mm: sum of Mn+Si+Cr≥2.900 and ≤3.200%

As a result of the possibility, described in the process claims 24 and 25, of hot dip refinement (for example, hot-dip galvanizing) of steel strips made from the steel according to the invention with high silicon contents of up to 0.500%, an addition of vanadium can be dispensed with to ensure the tempering resistance.

According to the invention, the microstructure is composed of the main phases ferrite and martensite and the secondary phase bainite, which determines the improved mechanical properties of the steel.

The steel according to the invention is characterized by low carbon equivalents and, in the case of the carbon equivalent CEV (IIW), is limited to max. 0.66% in dependence on the sheet thickness, in order to achieve excellent weldability and the further specific properties described below. For sheet thicknesses up to 1.00 mm a CEV (IIW) value of max. 0.62% has proven advantageous, for sheet thicknesses of up to 2.00 mm a value of max. 0.64%, and above 2.00 mm a value of max. 0.66%.

Due to its chemical composition, the steel according to the invention can be produced within a broad range of hot rolling parameters, for example with coiling temperatures above the bainite starting temperature (variant A). In addition, by controlling the process in a targeted manner a microstructure can be adjusted which allows the steel according to the invention to be cold rolled without prior soft annealing, wherein degrees of cold rolling between 10 to 40% per cold rolling pass can be used.

The steel according to the invention is very suitable as a starting material for a hot dip refining and has a significantly widened process window as compared to the known steels, due to the aggregate amount of Mn, Si and Cr added according to the invention as a function of the strip thickness to be produced.

Tests have surprisingly shown that a wide process window within which the required mechanical properties are obtained can be maintained when the total content of Mn+Si+Cr is adjusted according to sheet thickness.

This results in an increased process reliability during the continuous annealing of cold and hot-strips with dual- or multi-phase microstructures. Therefore, more homogeneous mechanical-technological properties can be adjusted in the strip for continuous-annealed hot or cold strips even in the case of different cross-sections and otherwise same process parameters.

This applies to continuous annealing of successive strips with different strip cross sections, as well as to strips with varying strip thickness over strip length or width. For example, this allows processing in selected thickness ranges (for example, less than 1.00 mm strip thickness, 1.00 mm to 2.00 mm strip thickness, and over 2.00 mm strip thickness).

When high-strength hot or cold strips with varying strip thicknesses are produced from multi-phase steel according to the invention in the continuous annealing process, components which are load-optimized components can be produced from these hot or cold strips.

The steel strip according to the invention can be produced as a cold and hot strip as well as a cold re-rolled hot strip by means of a hot-galvanizing line or a pure continuous annealing line in the skin passed and non skin passed state, in the stretch-bent and non-stretch-bent state and also in the heat-treated (over-aged) state.

With the alloy composition according to the invention, steel strips can be produced by intercritical annealing between $A_{c1}$ and $A_{c3}$, or by austenitizing annealing over $A_{c3}$ with final controlled cooling, which leads to a dual or multi-phase microstructure.

Annealing temperatures of about 700 to 950° C. have been found to be advantageous. Depending on the overall process (continuous annealing or additional hot dip finishing), there are different approaches for heat treatment.

In the case of a continuous annealing plant without subsequent hot dip refining, the strip is cooled from the annealing temperature to an intermediate temperature of approximately 160 to 250° C. at a cooling rate of about 15 to 100° C./sec. Optionally, it is possible to cool beforehand to a prior intermediate temperature of 300 to 500° C. with a cooling rate of about 15 to 100° C./sec. The cooling to room temperature is finally performed at a cooling rate of about 2 to 30° C./sec (see method 1, FIG. 6*a*).

In the case of a heat treatment in a hot dip refining, two temperature profiles are possible. The cooling is stopped as described above before entering the hot dip bath and is continued only after the exit from the bath until the intermediate temperature of about 200 to 250° C. is reached. Depending on the hot dip bath temperature, this results in a holding temperature in the hot dip bath of about 400 to 470° C. The cooling to room temperature is again performed at a cooling rate of about 2 to 30° C./sec (see method 2, FIG. 6*b*).

The second variant of the temperature profile during hot dip refining involves maintaining the temperature for about 1 to 20 s at the intermediate temperature of about 200 to 350° C. and then reheating to the temperature of about 400 to 470° C. required for hot dip refining. The strip is cooled again to about 200 to 250° C. after refining. The cooling to room temperature is again performed at a cooling rate of about 2 to 30° C./sec (see method 3, FIG. 6*c*). In known dual-phase steels, in addition to carbon, also manganese, chromium and silicon are responsible for the transformation of austenite to martensite. The combination of the elements carbon, silicon, manganese, nitrogen, molybdenum and chromium, as well as niobium, titanium, and boron, which are added within the given limits, ensures the required mechanical properties such as minimum tensile strengths of 950 MPa, while also significantly widening the process window during continuous annealing.

It is also characteristic for the material that as a result of adding manganese at increasing weight percentages, the ferritic region is shifted to longer time periods and lower temperatures during cooling. The proportions of ferrite are thereby reduced to a greater or lesser extent by increased amounts of bainite depending on the process parameters.

By adjusting a low carbon content of ≤0.115% by weight, the carbon equivalent can be reduced, thereby improving the weldability and avoiding excessive hardening during welding. In the case of resistance spot welding, the electrode life can also be significantly increased.

The effect of the elements in the alloy according to the invention is described in more detail below. Accompanying elements are inevitable and are considered in the analysis concept with regard to their effect, if necessary.

Accompanying elements are elements that are already present in the iron ore, or due to the production process in the steel. Due to their predominantly negative influences, they are generally undesirable. These elements are sought to be removed to a tolerable content or to transform them into more harmless forms.

Hydrogen (H) is the only element that can diffuse through the iron lattice without generating lattice strains. As a result hydrogen is relatively mobile in the iron lattice and can be absorbed relatively easily during the processing of the steel. Hydrogen can only be absorbed into the iron lattice in atomic (ionic) form.

Hydrogen is highly embrittling and diffuses preferentially to energetically favorable sites (defects, grain boundaries, etc.). hereby defects function as hydrogen traps and can significantly increase the residence time of the hydrogen in the material.

Recombination to molecular hydrogen can lead to cold cracking. This behavior occurs with hydrogen embrittlement or with hydrogen-induced stress corrosion cracking. Hydrogen is also often identified as the cause in the so-called delayed fracture, which occurs without external stresses. Therefore, the hydrogen content in the steel should be as low as possible.

A more uniform structure, which in the steel according to the invention is achieved inter alia by its widened process window, also reduces the susceptibility to hydrogen embrittlement.

Oxygen (O): In the molten state, the steel has a relatively high absorption capacity for gases. At room temperature, however, oxygen is only soluble in very small amounts. Analogous to hydrogen, oxygen can diffuse into the material only in atomic form. Owing to the highly embrittling effect and the negative effects on aging resistance, attempts are made to reduce the oxygen content during production as far as possible.

To reduce the oxygen, process-engineering approaches such as vacuum treatment and analytical approaches exist. By adding certain alloying elements, the oxygen can be converted into more harmless states. Thus, the oxygen is typically bound by manganese, silicon and/or aluminum in the course of a deoxidation of the steel. However, the resulting oxides may cause negative properties as defects in the material.

For these reasons the oxygen content in the steel should therefore be as low as possible.

Phosphorus (P) is a trace element from the iron ore and is dissolved in the iron lattice as a substitution atom. Phosphorus increases the hardness by solid-solution strengthening and improves the hardenability. However, it is usually sought to lower the phosphorous content as far as possible because inter alia due to its slow diffusion speed it has a strong tendency to segregation and strongly lowers tenacity. Deposition of phosphorus at the grain boundaries can lead to grain boundary cracks. In addition phosphorous increases the transition temperature from tenacious to brittle behavior by up to 300° C. During hot rolling, surface-proximate phosphorous oxides can lead to separation at the grain boundaries.

However, due to the low costs and the high strength increase, phosphorous is used in some steels in low amounts (<0.1%) as micro-alloying element for example in high strength IF-steels (interstitial free), bake hardening steels or also in some alloying concepts for dual-phase steels. The steel according to the invention differs from known analysis concepts which use phosphorus as a solid solution former, inter alia because phosphorus is not added but is adjusted as low as possible.

For the reasons mentioned above, the phosphorus content in the steel according to the invention is limited to quantities unavoidable in steel production.

Sulfur (S), like phosphorus, is bound in the iron ore as a trace element. Sulfur is undesirable in the steel (exception automate steels), since it is prone to severe segregation and is highly embrittling. It is therefore sought to obtain as low a content of sulfur in the melt as possible, e.g. by vacuum treatment. Furthermore, by adding manganese the present sulfur is converted into the relatively harmless compound manganese sulfide (MnS). The manganese sulfides are often rolled out band-like during rolling and function as germination sites for the transformation. Especially in the case of diffusion-controlled transformation this leads to a microstructure that is configured band-like and can lead to impaired mechanical properties in the case of strongly pronounced banding (for example pronounced martensite bands instead of distributed martensite islands, anisotropic material behavior, reduced elongation at brake).

For the reasons mentioned above, the sulfur content in the steel according to the invention is limited to ≤0.0030% by weight, advantageously to ≤0.0025% by weight or optimally to ≤0.0020% by weight, or to unavoidable quantities in steel production.

Alloying elements are generally added to the steel in order to influence specific properties in a targeted manner. An alloying element can influence different properties in different steels. The effect is generally dependent on the amount and the state of solution in the material.

The interactions can therefore be quite diverse and complex. The effect of the alloying elements will be discussed in more detail below.

Carbon (C) is the most important alloying element in steel. Its targeted introduction of up to 2.06% by weight, is required to turn iron into the steel. Often the carbon content is drastically reduced during steel production. In the case of dual-phase steels for a continuous hot dip coating, its content is at most 0.230% by weight according to EN 10346 or VDA 239-100, a minimum value is not specified.

Due to its relatively small atomic radius carbon is dissolved interstitially in the iron lattice. The solubility in the α-iron is maximally 0.02% and in the γ-iron maximally 2.06%. In solubilized form carbon significantly increases the hardenability of steel and is thus indispensable for the formation of sufficient amounts of martensite. Excessive carbon contents, however, increase the hardness difference between ferrite and martensite and limit weldability.

To meet the requirements e.g. with respect to high hole expansion and bending angles, the steel according to the invention contains less than 0.115% carbon by weight.

Due to the different solubility of carbon in the phases, pronounced diffusion processes during the phase transformation are necessary, which can lead to very different kinetic conditions. In addition, carbon increases the thermodynamic stability of austenite, which is shown in the phase diagram in an expansion of the austenite region to lower temperatures. As the content of force-solubilized carbon increases in the martensite, the lattice distortions increase and with this the strength of the non-diffusively generated phase.

Carbon also forms carbides. A cementite phase ($Fe_3C$) occurs in almost every steel. However, much harder special carbides can also form with other metals such as, for example, chromium, titanium, niobium, vanadium. Not only the type but also the distribution and size of the precipitations is of decisive importance for the resulting increase in strength. In order to ensure a sufficient strength on one hand and a good weldability, improved hole expansion, improved bending angle, and sufficient resistance to hydrogen-induced cracking (i.e., delayed fracture free) on the other hand the minimum C-content is set to be 0.075% by weight and the maximal C-content to 0.115% by weight; advantageous are and contents that are adjusted depending on the cross-section, such as:

Material thickness less than 1.00 mm (C of ≤0.100% by weight)

Material thicknesses between 1.00 to 2.00 mm (C≤0.105 by weight.)

Material thicknesses above 2.00 mm (C≤0.115% by weight).

Silicone (Si) binds oxygen during casting and is thus used for deoxidizing the steel. Important for the later steel properties is that the segregation coefficient is significantly lower than that of for example manganese (0.16 compared to 0.87). Segregations generally lead to a banded arrangement of the microstructure components, which impair the forming properties, for example the hole expansion and the bending ability.

Characteristically the addition of silicone results in strong solid solution hardening. The addition of 0.1% silicone results in an approximate increase of the tensile strength by about 10 MPa, wherein up to 2.2% silicone impairs expansion only insignificantly. In this context different sheet thicknesses and annealing temperatures where observed. The increase from 0.2% to 0.6% silicone resulted in a strength increase of about 20 MPa in yield strength and about 70 MPa in tensile strength. The elongation at break hereby decreases by only about 2%. The latter results inter alia from the fact that silicone lowers the solubility of carbon in ferrite, which causes the ferrite to be softer, which in turn improves formability. In addition silicone prevents the formation of carbides, which lower ductility as brittle phases. The low strength increasing effect of silicone within the range of the steel according to the invention forms the basis of a wide process window.

Another important effect is that silicon shifts the formation of ferrite to shorter times and temperatures, thus enabling the formation of sufficient ferrite prior to quenching. During hot-rolling, this provides a basis for improved cold-rollability. In the hot dip coating process, the austenite is enriched with carbon by the accelerated ferrite formation and thus stabilized. Since silicon hinders carbide formation, the austenite is additionally stabilized. Thus, in the accelerated cooling, the formation of bainite can be suppressed in favor of martensite.

The addition of silicon in the range according to the invention has led to further surprising effects described below. The above-described retardation of carbide formation could e.g. also be caused by aluminum. However, aluminum forms stable nitrides so that there is not enough nitrogen available for the formation of carbonitrides with microalloying elements. Due to the alloying with silicon, this problem does not exist, since silicon does not form carbides or nitrides. Thus, silicon has an indirect positive effect on the formation precipitates by microalloys, which in turn has a positive effect on the strength of the material. Since the increase in the transformation temperatures by silicon tends to favor grain coarsening, a microalloying with niobium, titanium and boron is particularly suitable, as is the targeted adjustment of the nitrogen content in the steel according to the invention.

As is known, in steels with high-silicone-alloyed steels it is expected that strongly adhering red scale forms and a higher risk of rolled-in scale arises during hot rolling which may influence the subsequent pickling result and the pickling productivity. This effect could not be detected in the steel according to the invention with 0.400% to 0.500% silicone when the pickling was advantageously performed with hydrochloric acid instead with sulfuric acid With regard to the galvanization capacity of silicone-containing steels, DE 196 10 675 C1 describes inter alia that steels with up to 0.800% silicone or up to 2.000% silicone cannot be hot dip galvanized due to the very poor wettability of the steel surface with the liquid zinc.

Beside the recrystallization of the full hard strip, the atmospheric conditions in a continuous hot dip galvanizing facility during the annealing treatment cause a reduction of iron oxide, which may form on the surface for example during cold rolling or as a result of storage at room temperature. However, for oxygen-affine alloy components, such as silicone, manganese, chromium, boron the overall atmosphere is oxidizing, which may result in segregation and selective oxidation of these elements. The selective oxidation can occur externally, i.e., on the substrate surface as well as internally in the metallic matrix.

It is known that during annealing in particular silicone can diffuse to the surface and by itself or together with manganese form film-like oxides. These oxides can prevent contact between the substrate and the melt and prevent or significantly impair the wetting reaction. As a result un-galvanized sites, so-called "bare spots" or even large-surface regions without coating can occur. Furthermore the impaired wetting reaction may result in insufficient formation of an inhibition layer and thus decrease the adhesion of the zinc or zinc alloy layer on the substrate. The above-mentioned mechanisms also apply to a pickled hot strip or cold re-rolled hot strip.

Contrary to this general knowledge, tests have unexpectedly shown that solely by suitably operating the furnace during recrystallizing annealing and during passage through the zinc bath a good galvanizability of the steel strip and a good zinc adhesion can be achieved.

For this purpose the strip surface first has to be freed of residual scale, rolling oil or other dirt particles by a chemical or thermal-hydro-mechanical pre-cleaning. In order to prevent silicone oxides from reaching the surface, measures also have to be taken to promote the inner oxidation of the alloy elements below the surface of the material. Depending on the configuration of the facility, different measures are used for this purpose.

In a facility configuration in which the annealing process step is performed exclusively with a radiant tube furnace (RTF) (see method 3 in FIG. 6*c*), the inner oxidation of the alloy elements can be influenced in a targeted manner by adjusting the oxygen partial pressure of the furnace atmosphere ($N_2$—$H_2$ protective gas atmosphere). The adjusted oxygen partial pressure hereby has to satisfy the following equation, wherein the furnace temperature is between 700 and 950° C.

$$-12>\text{Log } pO_2 \geq 5*Si^{-0.25}-3*Mn^{-05}-0.1*Cr^{-0.5-7}*(-InB)^{0.5}$$

Hereby Si, Mn, Cr, B denote the corresponding alloying components in the steel in percent by weight and $pO_2$ the oxygen partial pressure in mbar.

In a configuration of a facility in which the furnace region consists of a combination of a direct fired furnace (DFF or non-oxidizing furnace NOF) and a subsequent radiant tube furnace (see method 2 in FIG. 6*b*) the selective oxidation can also be influenced via the gas atmosphere of the furnace regions.

Via the combustion reaction in the NOF the oxygen partial pressure and with this the oxidation potential for iron and the alloy components can be adjusted. The oxidation potential is to be adjusted so that the oxidation of the alloy elements occurs internally, below the steel surface and a thin iron oxide layer may form on the steel surface after passage through the NOF region. This is achieved for example via reducing the CO-value below 4%.

In the subsequent radiant tube furnace the iron oxide layer, which may have formed and also the alloy elements are further reduced under a $N_2$—$H_2$ protective gas atmosphere. The adjusted oxygen partial pressure in this furnace region hereby has to satisfy, the following equation, wherein the furnace temperature is between 700 and 950° C.

$$-18>\text{Log } pO_2 \geq 5*Si^{-0.3}-2.2*Mn^{-0.45}-0.1*Cr^{-0.4-12.5}*(-InB)^{0.25}$$

Hereby Si, Mn, Cr, B designate the corresponding alloy proportions in the steel in mass % and $pO_2$ the oxygen partial pressure in mbar.

In the transition region between furnace→zinc pot (tuyere snout) the dew point of the gas atmosphere ($N_2$—$H_2$ protective gas atmosphere) and with this the oxygen partial pressure is to be adjusted so that oxidation of the strip is avoided prior to immersion into the melt bath. Dew points in the range of from −30 to −40° C. have proven advantageous.

The above-described measures in the furnace region of the continuous hot dip galvanizing plant prevent the surface formation of oxides and achieve a uniform good wettability of the strip surface with the liquid melt.

When instead of the hot dip galvanizing the process route of the continuous annealing with subsequent electrolytic galvanizing is selected (see method 1 in FIG. 6*a*), no special measures are required to ensure galvanizability. It is known that galvanizing of higher-alloyed steels can be realized significantly easier by electrolyte galvanizing than by continuous hot dip galvanizing. In electrolytic galvanizing, pure zinc is deposited directly on the strip surface. In order to not impair the electron flow between the steel strip and the zinc-ions and with this the galvanization, it has to be ensured that no surface-covering oxide layer is present on the strip surface. This condition is usually ensured by a standard reducing atmosphere during the annealing and a pre-cleaning prior to electrolysis.

In order to ensure a process window during the annealing that is as wide as possible and a sufficient galvanizing capacity the minimal Si-content is set to 0.600% and the maximal silicone content to 0.800%.

Manganese (Mn) is added to almost every steel for de-sulfurization in order to convert the deleterious sulfur into manganese sulfides. In addition, as a result of solid solution strengthening, manganese increases the strength of the ferrite and shifts the α-/γ-transformation toward lower temperatures.

A main reason for adding manganese in dual-phase steels is the significant improvement of the hardness penetration. Due to the diffusion impairment the perlite and bainite transformation is shifted toward longer times and the martensite start temperature is lowered.

At the same time, however, addition of manganese increases the hardness ratio between martensite and ferrite. In addition the banding of the microstructure is increased. A high hardness difference between the phases and the formation of martensite bands results in a lower hole expansion capacity, which has an adverse affect on edge crack resistance.

Like silicone, manganese tends to form oxides on the steel surface during the annealing treatment. Depending on the annealing parameters and the content of other alloy elements (in particular silicone and aluminum), manganese oxides (for example MnO) and/or Mn mixed oxides (for example $Mn_2SiO_4$) may form. However, manganese is less critical at a low Si/Mn or Al/Mn ratio because globular oxides instead of oxide films form. Nevertheless high manganese contents may negatively influence the appearance of the zinc layer and the zinc adhesion.

For the stated reasons the Manganese-content is set to 1.900 to 2.350% by weight.

For achieving the demanded minimal strengths, it is advantageous to vary the manganese content in dependence on the thickness.

For a strip thickness of less than 1.00 mm, the manganese content is preferably in a range between ≥1.900 and ≤2.100% by weight, in the case of strip thicknesses of 1.00 to 2.00 mm, between ≥2.050 and ≤2.250% by weight, in the case of band thicknesses above 2.00 mm between ≤2.100% by weight and ≤2.350% by weight.

A further special feature of the invention is that the variation of the manganese content can be compensated by a simultaneous change in the silicon content. The strength increase (here the yield strength, YS) as a result of manganese and silicon is generally described well by the Pickering equation:

$$YS\ (MPa)=53.9+32.34[wt\ \%\ Mn]+83.16[wt\ \%\ Si]+354.2[wt\ \%\ Ni]+17.402\ d^{(-1/2)}$$

This equation, however, is predominantly based on the effect of the solid solution hardening, which according to this equation is weaker for manganese than for silicone. At the same time, however, as mentioned above manganese significantly increases hardenability, which in multi-phase steels results in a significant increase of the proportion of strength-increasing second phase. Therefore in a first approximation the addition of 0.1% silicone is set equal to the addition of 0.1% manganese in the sense of strength increase. For a steel of the composition according to the invention and an annealing with the time-temperature parameters according to the invention, the following equation was empirically determined for the yield strength (YS) and the tensile strength (TS):

$$YS\ (MPa)=160.7+147.9[wt.\ \%\ Si]+161.1[wt.\ \%\ Mn]$$

$$TS\ (MPa)=324.8+189.4[wt.\ \%\ Si]+174.1[wt.\ \%\ Mn]$$

Compared to the Pickering equation, the coefficients of manganese and silicon are approximately equal for the yield strength as well as for the tensile strength, whereby the possibility of the substitution of manganese by silicon is given.

Chromium (Cr) in solubilized form can on one hand significantly increase the hardenability of steel already in small amounts. On the other hand chromium causes precipitation hardening at a corresponding temperature profile in the form of chromium carbides. The increase of the number of germination site's at simultaneously lowered carbon content leads to a lowering of the hardenability.

In dual-phase steels addition of chromium mainly improves the hardness penetration. In the solubilized state chromium shifts perlite and bainite transformation toward longer times and at the same time lowers the martensite start temperature.

Another important effect is that chromium considerably increases the tempering resistance, so that almost no loss of strength occurs in the hot dip bath.

Chromium is also a carbide former. When chromium-iron mixed carbides are present, the austenitization temperature before hardening should be selected high enough to dissolve the chromium carbides. Otherwise the increased number of nuclei may impair the hardness penetration.

Chromium also tends to form oxides on the steel surface during the annealing treatment, which may degrade melt smelting quality. By means of the above-mentioned measures for setting the furnace regions in the case of continuous melt immersion coating, the formation of Cr oxides or Cr mixed oxides on the steel surface after annealing is reduced.

The chromium content is therefore set to contents from 0.200 to 0.500% by weight.

Molybdenum (Mo): similar to chromium, addition of molybdenum improves hardenability. The perlite and bainite transformation is shifted toward longer times and the martensite start temperature is lowered. Molybdenum is also a strong carbide former, which permits the formation of finely distributed mixed carbides, among others also with titanium. Molybdenum also significantly increases the tempering resistance so that no strength losses are to be expected in the zinc bath, and causes an increase in strength of the ferrite as a result of solid solution strengthening, however less effectively than manganese and silicone The content of molybdenum is therefore adjusted to between 0.200 and 0.300% by weight. Advantageous are ranges between 0.200 and 0.250% by weight.

As a compromise between the required mechanical properties and galvanizing capability a sum content of Mo+Cr of ≤0.725% by weight has proven to be advantageous for the inventive alloy concept.

Copper (Cu): the addition of copper can increase tensile strength and hardness penetration. In connection with nickel, chromium and phosphorous, copper can form a protective oxide layer on the surface, which significantly reduces the corrosion rate.

When combined with oxygen, copper can form harmful oxides at the grain boundaries, which can have a negative effect on hot forming processes. The content of copper is therefore set to ≤0.050% by weight and is thus limited to quantities unavoidable in steel production.

Nickel (Ni): In combination with oxygen, nickel can form harmful oxides at the grain boundaries, which can have a negative impact on hot forming processes. The content of nickel is therefore set to ≤0.050% by weight and is thus limited to quantities unavoidable in steel production.

Vanadium (V): Since the addition of vanadium is not necessary in the present alloying concept, the content of vanadium is limited to unavoidable amounts of steel.

Aluminum (Al) is usually added to the steel to bind the dissolved oxygen and nitrogen in the iron. Oxygen and nitrogen are thus converted into aluminum oxides and aluminum nitrides. These precipitates can effect grain refinement by increasing the number of nucleation sites, thus increasing the toughness properties as well as strength values.

Aluminum nitride is not precipitated when titanium is present in sufficient amounts. Titanium nitrides have less enthalpy of formation and are formed at higher temperatures.

When dissolved, aluminum and silicon shift the ferrite formation to shorter times, thus enabling the formation of sufficient ferrite in the dual-phase steel. It also suppresses carbide formation and thus leads to a delayed transformation of the austenite. For this reason, aluminum is also used as an alloying element in residual austenite steels (TRIP steels) to substitute a portion of the silicon. The reason for this approach is that aluminum is somewhat less critical to the galvanizing reaction than silicon.

The aluminum content is therefore limited to 0.005 to maximally 0.060% by weight and is added to deoxidize the steel.

Niobium (Nb): Niobium has different effects in the steel. During hot rolling in the finishing train it delays recrystallization by forming ultra-finely distributed precipitates, which increases the density of germination sites and a finer grain is generated after transformation. Also the proportion of dissolved niobium inhibits recrystallization. In the final product the precipitates increase strength. These precipitates can be carbides or carbonitrides. Oftentimes these precipitates are mixed carbides, into which also titanium can be integrated. This effect starts manifesting itself at 0.0050% and is most pronounced above 0.010% by weight niobium. The precipitates also prevent grain growth during the (partial) austenitization in the hot dip galvanizing. Above 0.060% by weight niobium no additional effect is expected. Contents of 0.025 to 0.045 by weight have proven advantageous.

Titanium (Ti): Due to its high affinity for nitrogen, titanium is predominantly precipitated as TiN during solidification. It also occurs together with niobium as mixed carbide. TIN is of great importance for the grain size stability in the kiln. The precipitates have a high temperature stability so that, unlike the mixed carbides, at 1200° C. they are largely present as particles which hinder grain growth. Titanium also has a retarding effect on recrystallization during hot rolling but is less effective than niobium. Titanium acts by precipitation hardening. The larger TiN particles are less effective than the finer distributed mixed carbides. The best efficacy is achieved in the range of from 0.005 to 0.060% by weight of titanium, therefore this represents the alloying range according to the invention. For this purpose, contents of 0.025 to 0.045 weight % by weight have proven advantageous.

Boron (B): Boron is an extremely effective alloying agent for increasing the hardenability even in very small amounts (from 5 ppm). The martensite start temperature remains unaffected. To be effective, boron must be in solid solution. Because of its high affinity to nitrogen, the nitrogen first has to be bound, preferably by the stoichiometrically required amount of titanium. Due to its low solubility in iron, the solubilized boron is preferentially present at the austenite grain boundaries. There it partially forms Fe—B carbides, which are coherent and lower the grain boundary energy. Both effects have a delay the ferrite and perlite formation and thus increase the hardenability of the steel. Excessive amounts of boron however are deleterious because iron boride can form which has an adverse effect on the hardenability the formability and the tenacity of the material. In addition boron tends to form oxides or mixed oxides during the continuous hot dip coating, which impair the hot dip galvanizing quality. The above-mentioned measures for adjusting the furnace regions in the continuous hot dip coating reduce the formation of oxides at the steel surface For the reasons mentioned above, the boron content for the inventive alloy concept is set to values of 5 to 30 ppm, advantageously to ≤25 or optimally to ≤20 ppm.

Nitrogen (N) can be both an alloying element and an accompanying element from steel production. Excessively high nitrogen contents cause an increase in strength combined with a rapid loss of toughness as well as aging effects. On the other hand, fine-grain hardening via titanium nitrides and niobium (carbo) nitrides can be achieved by a targeted addition of nitrogen in conjunction with the microalloying elements titanium and niobium. In addition, formation of coarse grains is suppressed during reheating prior to hot rolling.

According to the invention, the N-content is therefore set to values of ≥0.0020 to ≤0.0120% by weight.

For maintaining the required properties of the steel it has been found to be advantageous when the content of nitrogen is adjusted as a function of the sum of Ti+Nb+B.

At a total content of Ti+Nb+B of ≥0.010 to ≤0.070 wt. %, the content of nitrogen should be kept at values of ≥20 to ≤90 ppm. For a sum content of Ti+Nb+B of >0.070% by weight, contents of nitrogen of ≥40 to ≤120 ppm have proven to be advantageous.

For the sum contents of niobium and titanium, contents of ≤0.100% by weight have proven to be advantageous and, owing to the fact that niobium and titaniumare exchangeable to a minimum niobium content of 10 ppm, and particularly advantageously of ≤0.090% by weight for reasons of cost.

with respect to the interplay of the microalloying elements niobium and titanium with boron, total contents of ≤0.102% by weight have proven to be advantageous and particularly advantageous of ≤0.092% by weight. Higher contents do not have any further improving effect in the sense of the invention.

In addition, as sum contents of Ti+Nb+V+Mo+B maximum contents of ≤0.365% by weight have proven advantageous for the aforementioned reasons.

Calcium (Ca): Addition of calcium in the form of calcium-silicon mixed compounds causes a deoxidation and desulfurization of the molten phase during the production of steel. Thus reaction products are transferred into the slag and the steel is cleaned. The increased purity leads to better properties according to the invention in the final product.

For the reasons mentioned, a Ca content of ≥0.005 to ≤0.0060 wt. % Is set.

Tests conducted with the steel according to the invention have shown that in case of an inter-critical annealing between $A_{c1}$ and $A_{c3}$ or an austenitizing annealing above $A_{c3}$ with subsequent controlled cooling, a dual-phase steel with a minimal tensile strength of 950 MPa at a thickness of 0.50 to 3.00 mm (for example for cold strip) can be produced, which is characterized by a sufficient tolerance toward process fluctuation This results in a significantly widened process window for the alloy composition according to the invention compared to known alloy concepts.

The annealing temperatures for the dual-phase structure to be achieved are between about 700 and 950° C. for the steel according to the invention, so that a partial austenitic (two-phase region) or a fully austenitic structure (austenite region) is achieved, depending on the temperature range.

The tests show that the established microstructure proportions after the inter-critical annealing between $A_{C1}$ and $A_{C3}$ or the austenitizing annealing above $A_{C3}$ with subsequent controlled cooling are maintained also after a further process step "hot dip coating" at temperatures between 400 to 470° C. for example with zinc or zinc-magnesium.

The continuous annealed and, as the case may be, hot dip refined material can be produced both as hot strip as well as cold re-rolled hot strip or cold strip in the skin-passed rolled (cold re-rolled) or non-skin-pass rolled state and/or in the stretch leveled or not stretch leveled state and also in the heat treated state (overageing). In the following this state is referred to as the initial state.

Steel strips, in the present case as hot strips, cold re-rolled hot strip or cold strip, made from the alloy composition according to the invention, are in addition characterized by a high resistance against edge-proximate crack formation during further processing.

The very small differences in the characteristic values of the steel strip along and transversely to its rolling direction are advantageous in the subsequent use of the material. Thus, plates can be cut from a strip independent of the rolling direction (for example transversely, longitudinally and diagonally, or at an angle to the rolling direction) and the waste can be minimized.

In order to ensure the cold-rollability of a hot-rolled strip produced from the steel according to the invention, the hot-rolled strip is produced according to the invention with final rolling temperatures in the austenitic region above $A_{c3}$ and at coiling temperatures above the bainite starting temperature (variant A).

In the case of a hot strip or cold re-rolled hot strip, for example with a cold-rolling degree of about 10%, the hot-rolled strip is produced according to the invention at final rolling temperatures in the austenitic region above $A_{c3}$ and coiling temperatures below the bainite starting temperature (variant B).

BRIEF DESCRIPTION OF THE DRAWING

Further features, advantages and details of the invention will become apparent from the following description of exemplary embodiments shown in a drawing.

It is shown in:

FIG. 1: Process chain (schematic) for the production of a strip from the steel according to the invention FIG. 2: Time-temperature profile (schematic) of the process steps of hot-rolling and cold-rolling (optional) and continuous annealing, component manufacturing, heat treatment (air hardening) and tempering (optional) exemplary for the steel according to the invention FIGS. 3*a*, 3*b*: Chemical composition of the investigated steels FIG. 4*a*: Mechanical characteristic values (along the rolling direction) as target values, air-hardened and not tempered FIG. 4*b*: Mechanical characteristic values (along the direction of rolling) of the stepped steels in the initial state FIG. 4*c*: Mechanical characteristic values (along the rolling direction) of the steered steels in the air-hardened, non-tempered state FIG. 5: Results of the hole spreading tests according to ISO 16630 and the plate bending test according to VDA 238-100 on steels according to the invention FIG. 6*a*: Method 1, temperature-time curves (annealing variants schematically)

FIG. 6*b*: Method 2, temperature-time curves (annealing variants schematically)

FIG. 6*c*: Method 3, temperature-time curves (annealing variants schematically)

DETAILED DESCRIPTION OF PREFERRED EMBODIMENTS

FIG. 1 shows a schematic illustration of the process chain for producing a strip from the steel according to the invention. The various process routes pertaining to the invention are illustrated. Until the hot rolling (final rolling temperature), the process route is the same for all steels according to the invention, afterwards, depending on the desired results, different process routes take place. For example, the pickled hot strip can be galvanized or cold-rolled and galvanized with different degrees of rolling. It is also possible to cold-rolled and galvanized hot-annealed hot-rolled strip or soft-annealed cold strip.

Optionally it is also possible to process material without hot dip refining, i.e., only by continuous annealing with and without subsequent electrolytic galvanizing. A complex component can now be produced from the optionally coated material. Subsequently, the hardening process takes place, in which cooling is performed at air in accordance with the invention. Optionally, a tempering stage can complete the temperature treatment of the component.

FIG. 2 schematically shows the time-temperature profile of the process steps hot rolling and continuous annealing of strips made from the alloy composition according to the invention. The time and temperature-dependent transformation for the hot-rolling process as well as for a heat treatment after cold-rolling, component production, quenching and tempering and optional tempering are shown.

FIG. 3a shows the chemical composition of the investigated steels. LH®1100 alloys according to the invention were compared with the reference grades LH®800/LH®900.

Compared to the reference grades, the alloys according to the invention have, in particular, significantly increased contents of Si and lower contents of Cr and no added V.

FIG. 3*b* shows the sum contents of various alloying components in percent by weight and the respectively determined carbon equivalent CEV (IIW) is stated.

FIG. 5 shows results of the hole expansion tests according to ISO 16630 (absolute values). The results of the hole expansion tests for variant A (coiling temperature above bainite starting temperature) for process 2 (FIG. 6*b*, 1.2 mm) and process 3 (FIG. 6*c*, 2.0 mm) are shown.

The investigated materials have a sheet thickness of 1.2 and 2.0 mm, respectively. The results apply to the test according to ISO 16630.

Method 2 corresponds for example to an annealing on a hot galvanizing with a combined direct-fired furnace and a radiant tube furnace as described in FIG. 6*b*.

Method 3 corresponds, for example, to a process control in a continuous annealing system as described in FIG. 6*c*. In addition, by means of an induction furnace, a reheating of the steel can be achieved in this case directly before the zinc bath.

The different temperature profiles according to the invention within the mentioned range, result in different characteristic values or also different hole expansion results as well as bending angles. The principal differences are thus the temperature-time parameters during the heat treatment and the subsequent cooling.

FIG. 6 schematically shows three variants of the temperature-time curves according to the invention during the annealing treatment and cooling and in each case various austenitization conditions.

Method 1 (FIG. 6*a*) shows the annealing and cooling of the produced cold-rolled or hot-rolled or cold-re-rolled steel strip in a continuous annealing line. First, the strip is heated to a temperature in the range of about 700 to 950° C. (Ac1 to Ac3). The annealed steel strip is then cooled from the annealing temperature to an intermediate temperature (IT) of about 200 to 250° C. at a cooling rate between about 15 and 100° C./sec. A second intermediate temperature (about 300 to 500° C.) is not shown in this schematic illustration.

Subsequently, the steel strip is cooled at air at a cooling rate of between about 2 and 30° C./sec until room temperature (RT) is reached, or the cooling to room temperature is maintained at a cooling rate of between about 15 and 100° C./sec.

Method 2 (FIG. 6*b*) shows the process according to method 1, however, for the purpose of hot dip finishing the cooling of the steel strip is intermittently interrupted during the passage through the hot dip vessel to then cool to an intermediate temperature of about 200 to 250° C. at a cooling rate of between about 15 and 100° C./s. Subsequently, the steel strip is cooled at air at a cooling rate of between about 2 and 30° C./sec until room temperature is reached.

Method 3 (FIG. 6*c*) also shows the process according to method 1 in the case of a hot dip refining, but the cooling of the steel strip is interrupted by a short pause (about 1 to 20 s) at an intermediate temperature in the range of approx. 200 to 400° C. and reheated to the temperature (ST) necessary for the hot dip immersion (about 400 to 470° C.). Subsequently, the steel strip is cooled again to an intermediate temperature of approximately 200 to 250° C. With a cooling rate of approx. between 2 and 30° C./s, the final cooling of the steel strip takes place at air until room temperature is reached.

The following examples are used for industrial production for the hot-dip galvanizing according to method 2 according to FIG. 6*b* and according to method 3 according to FIG. 6*c* with a lab-borated coating process:

Example 1 (Cold Strip) (Alloy Composition in % by Weight)

Variant A/1.2 mm/Method 2 According to FIG. 6*b*

A steel according to the invention with 0.099% C; 0.461% Si; 2.179% Mn; 0.009% P; 0.001% S; 0.0048% N; 0.040 Al; 0.312% Cr; 0.208% Mo; 0.0292% Ti; 0.0364% Nb;

0.0012% B; 0.0015% Ca hot dip refined according to method 2 according to FIG. 6*b*, the material was hot-rolled beforehand at a final rolling target temperature of 910° C. and coiled at a final rolling target temperature of 650° C. with a thickness of 2.30 mm and after pickling without additional heat treatment (such as annealing) cold rolled twice with an intermediate thickness of 1.49 mm.

In an annealing simulator, a hot dip refined, air-hardened steel strip was processed with the following parameters
Annealing temperature 870° C.
Holding time 120 s
Transport time max. 5 s (without energy input)
Subsequent cooling at air After tempering, the steel according to the invention has a microstructure consisting of martensite, bainite and residual austenite.

This steel shows the following characteristic values after air hardening (initial values in brackets, unprocessed condition) Along the rolling direction, and would correspond, for example, to an LH®1100:

| | |
|---|---|
| Yield strength (Rp0.2) | 921 MPa (768 MPa) |
| Tensile strength (Rm) | 1198 MPa (984 MPa) |
| Elongation at break (A80) | 5.5% (10.7%) |
| A5 elongation | 9.5% (—) |
| Bake Hardening Index (BH2) | 52 MPa |
| Hole expansion ratio according to ISO 16630 | — (49%) |
| Bending angle accord. to VDA 238-100 (longitudinal, transverse) | — (122°/112°) |

The yield ultimate ratio Re/Rm in the longitudinal direction was 78% in the initial state.

Example 2 (Cold Strip) (Alloy Composition in % by Weight)

Variant B/2.0 mm/Method 3 According to FIG. 6*c*

A steel according to the invention with 0.100% C; 0.456% Si; 2.139% Mn; 0.010% P; 0.001% S; 0.0050% N; 0.058 Al; 0.313% Cr; 0.202% Mo; 0.0289% Ti; 0.0337% Nb; 0.0009% B; 0.0021% Ca hot dip refined according to method 3 according to FIG. 6*c*, the material was subjected beforehand to hot rolling at a final rolling target temperature of 910° C. and was coiled at a core coiling temperature of 650° C. with a thickness of 2.30 mm and after the pickling was cold rolled without additional heat treatment (such as, batch annealing).

In an annealing simulator, the hot dip refined steel was processed with the following parameters analogous to a temperature treatment process (air-hardening):
Annealing temperature 870° C.
Holding time 120 s
Transport time max. 5 s (without energy input)
Subsequent cooling at air After tempering, the steel according to the invention has a microstructure consisting of martensite, bainite and residual austenite.

This steel shows the following characteristic values after air hardening (initial values in brackets, unprocessed condition) along the rolling direction, and would correspond, for example, to an LH®1100:

| | |
|---|---|
| Yield strength (Rp0.2) | 903 MPa (708 MPa) |
| Tensile strength (Rm) | 1186 MPa (983 MPa) |
| Elongation at break (A80) | 7.1% (11.7%) |
| A5 elongation | 9.1% (—) |

-continued

| | |
|---|---|
| Bake Hardening Index (BH2) | 48 MPa |
| Hole expansion ratio according to ISO 16630 | — (32%) |
| Bending angle accord. to VDA 238-100 (longitudinal, transverse) | — (104°/88°) |

The yield ultimate ratio Re/Rm in the longitudinal direction was 72% in the initial state.

What is claimed is:

1. An ultra-high-strength air-hardenable multiphase steel having minimal tensile strengths in a non air hardened state of 950 MPa and excellent processing properties, said steel comprising the following elements in % by weight:

C≥0.075 to ≤0.115
Si≥0.400 to ≤0.500
Mn≥1,900 to ≤2,350
Cr≥0.200 to ≤0.500
Al≥0.005 to ≤0.060
N≥0.0020 to ≤0.0120
S≤0.0030
Nb≥0.005 to ≤0.060
Ti≥0.005 to ≤0.060
B≥0.0005 to ≤0.0030
Mo≥0.200 to ≤0.300
Ca≥0.0005 to ≤0.0060
Cu≤0.050
Ni≤≤0.050 remainder iron, including usual steel accompanying smelting related impurities, wherein for a widest possible process window during continuous annealing of hot rolled or cold rolled strips made from said steel a sum content of M+Si+Cr in said steel is a function of a thickness of the steel strips according to the following relationship:

for strip thicknesses of up to 1.00 mm the sum content of M+Si+Cr is ≥2.800 and s 3.000%, for strip thicknesses of over 1.00 to 2.00 mm the sum of Mn+Si+Cr is ≥2.850 and ≤3.100%, and for strip thicknesses of over 2.00 mm the sum of Mn+Si+Cr is ≥2.900 and ≤3.200%.

2. The steel of claim 1, wherein for strip thicknesses of up to 1.00 mm the C-content is ≤0.100% and a carbon equivalent CEV (IIW) of the steel is ≤0.62%.

3. The steel of claim 1, wherein for strip thicknesses of more than 1.00 to 2.00 mm, the C-content is ≤0.105% and a carbon equivalent CEV (IIW) of the steel is ≤0.64%.

4. The steel of claim 1, wherein for strip thicknesses of more than 2.00 mm, the C content is ≤0.115% and a carbon equivalent CEV (IIW) of the steel is ≤0.66%.

5. The steel of claim 1, wherein for strip thicknesses of up to 1.00 mm the Mn content is ≥1.900 to ≤2.200%.

6. The steel of claim 1, wherein for strip thicknesses above 1.00 to 2.00 mm the Mn content is ≥2.050 to ≤2.250%.

7. The steel of claim 1, wherein for strip thicknesses above 2.00 mm, the Mn content is ≥2.100 to ≤2.350%.

8. The steel of claim 1, wherein at a sum of the contents of Ti+Nb+B of ≥0.010 to ≤0.070% the N content is ≥0.0020 to ≤0.0090%.

9. The steel of claim 1, wherein at a sum of the contents of Ti+Nb+B of >0.070% the N content is ≥0.0040 to ≤0.0120%.

10. The steel of claim 1, wherein the S content is ≤0.0025%.

11. The steel of claim 1, wherein the S content is ≤0.0020%.

12. The steel of claim 1, wherein the Mo content is ≤0.250%.

13. The steel of claim 1, wherein the Ti content is ≥0.025 to ≤0.045%.

14. The steel of claim 1, wherein the Nb content is ≥0.025 to ≤0.045%.

15. The steel of claim 1, wherein a sum of the contents of Nb+Ti is ≤0.100%.

16. The steel of claim 1, wherein a sum of the contents of Nb+Ti is ≤0.090%.

17. The steel of claim 1, wherein a sum of the contents of Cr+Mo is ≤0.725%.

18. The steel of claim 1, wherein a sum of the contents of Ti+Nb+B is ≤0.102%.

19. The steel of claim 1, wherein a sum of the contents of Ti+Nb+B is ≤0.092%.

20. The steel of claim 1, wherein a sum of the contents of Ti+Nb+B+Mo+V is ≤0.365%.

21. The steel of claim 1, wherein the Ca content is ≤0.0030%.

22. The steel of claim 1, wherein the contents of silicon and manganese with respect to strength properties to be achieved are interchangeable according to the relationship:

$$YS\ (MPa)=160.7+147.9[\%\ SI]+161.1[\%\ Mn]$$

$$TS\ (MPa)=324.8+189.4[\%\ Si]+174.1[\%\ Mn].$$

23. A method for producing a cold-rolled or hot-rolled steel strip from a multi-phase, air-hardenable steel comprising the following elements in % by weight:

C≥0.075 to ≤0.115
Si≥0.400 to ≤0.500
Mn≥1,900 to ≤2,350
Cr≥0.200 to ≤0.500
Al≥0.005 to ≤0.060
N≥0.0020 to ≤0.0120
S≤0.0030
Nb≥0.005 to ≤0.060
Ti≥0.005 to ≤0.060
B≥0.0005 to ≤0.0030
Mo≥0.200 to ≤0.300
Ca≥0.0005 to ≤0.0060
Cu≤0.050
Ni≤0.050, remainder iron, including usual steel accompanying smelting related impurities, wherein for a widest possible process window during continuous annealing of hot rolled or cold rolled strips made from said steel a sum content of M+Si+Cr in said steel is a function of a thickness of the steel strips according to the following relationship:

for strip thicknesses of up to 1.00 mm the sum content of M+Si+Cr is ≥2.800 and ≤3.000%, for strip thicknesses of over 1.00 to 2.00 mm the sum of Mn+Si+Cr is ≥2.850 and ≤3.100%, and for strip thicknesses of over 2.00 mm the sum of Mn+Si+Cr is ≥2.900 and ≤3.200%, said method comprising:

continuously annealing the multi-phase, air-hardenable steel to produce a cold-rolled or hot-rolled steel strip;

heating the cold-rolled or hot-rolled steel strip during the continuous annealing to a temperature in the range from about 700 to 950° C.;

cooling the annealed steel strip from the annealing temperature to a first intermediate temperature of about 300 to 500° C. with a cooling rate of between about 15 and 100° C./s; and after the cooling to the intermediate temperature treating the steel strip as set forth under a) or b):

a) cooling the steel strip to a second intermediate temperature of about 160 to 250° C. with a cooling rate of between 15 and 100° C./s and after cooling to the second intermediate temperature cooling the steel strip at air to room temperature;

b) maintaining the cooling of the steel strip with a cooling rate of between about 15 and 100'C/s from the first intermediate temperature to room temperature.

24. The method of claim 23, further comprising after the heating step and during the cooling to the first intermediate temperature step hot dip coating the steel strip in a hot dip bath, wherein the cooling to the first intermediate temperature is interrupted prior to entry into the hot dip bath, and after the cooling to the first intermediate temperature the steel strip is treated as set forth under a), wherein the second intermediate temperature is 200 to 250° C. and the cooling from the second intermediate temperature to room temperature is conducted with a cooling rate of about 2 and 30° C./s.

25. The method of claim 23, wherein the steel strip is treated as set forth under a), wherein the second intermediate temperature is 200 to 250° C., said method further comprising after the cooling to the second intermediate temperature and prior to the cooling to room temperature, holding the second intermediate temperature for about 1 to 20 seconds, reheating the steel strip to a temperature of about 400 to 470° C., hot dip coating the steel strip, and cooling the steel strip to the second intermediate temperature of 200 to 250° C. with a cooling rate of between about 15 and 100° C./s, wherein the cooling from the second intermediate temperature to room temperature is conducted with a cooling rate of about 2 and 30° C./s.

26. The method of claim 23, wherein the heating step is performed using a plant configuration comprising a directly fired furnace and a radiant tube furnace, and wherein the method further comprises increasing an oxidation potential during the heating by setting a CO-content in the directly fired furnace below 4%, setting an oxygen partial pressure of an atmosphere of the radiant tube furnace according to the following equation, $$18>\mathrm{Log}\ pO_2 \geq 5*Si^{-0.3}-2.2*Mn^{-0.45}-0.1*Cr^{-0.4}-12.5*(-InB)^{0.25},$$

wherein Si, Mn, Cr and B are corresponding alloy proportions in the steel in % by weight and $pO_2$ is the oxygen partial pressure in mbar, and wherein a dew point of an overall atmosphere of the plant configuration is set to −30° C. or below for avoiding oxidation of the strip directly prior to immersion into a hot dip bath.

27. The method of claim 23, wherein the heating is performed with a single radiant tube furnace, and wherein an oxygen partial pressure of an atmosphere of the radiant tube furnace satisfies the following equation, $$-12>\mathrm{Log}\ pO_2 \geq 5*Si^{-0.25}-3*Mn^{-0.5}-0.1*Cr^{-0.5}-7*(-InB)^{0.5}$$

wherein Si, Mn, Cr, and B are corresponding alloy components in the steel in % by weight and $pO_2$ is the oxygen partial pressure in mbar, and wherein a dew point of an overall atmosphere of the plant configuration is set to −30° C. or below for avoiding oxidation of the strip directly prior to immersion into a hot dip bath.

28. The method of claim 23, further comprising adjusting a plant throughput speed to different thicknesses of respective steel strips so that heat treatment of the respective steel strips results in similar microstructures and mechanical characteristic values.

29. The method of claim 23, further comprising after the heating and cooling steps skin-passing the steel strip.

30. The method of claim 23, further comprising after the heating and cooling steps stretch leveling the steel strip.

31. A steel strip produced by the method of claim 23 and having a minimum hole-expansion value according to ISO 16630 of 20% in a non-air-hardened state.

32. The steel strip of claim 31, having a minimum hole-expansion value according to ISO 16630 of 25% in a non-air-hardened state.

33. The steel strip of claim 31, having a minimum bending angle according to VDA 238-100 of 50° in a longitudinal direction or transverse direction in a non-air-hardened state.

34. The steel strip of claim 31, having a minimum bending angle according to VDA 238-100 of 65° in a longitudinal direction or transverse direction in a non-air-hardened state.

35. The steel strip of claim 31, having a minimum product value tensile strength Rm x bending angle α according to VDA 238-100 of 100,000 MPa ° in a non-air-hardened state.

36. The steel strip of claim 31, having a minimum product value tensile strength Rm x bending angle α according to VDA 238-100 of 120,000 MPa ° in the non-air-hardened state.

37. The steel strip of claim 31, having a delayed fracture free state for at least 6 months, meeting the requirements of SEP 1970 for perforated tensile and bent beam test.

* * * * *